United States Patent [19]

Hippach

[11] Patent Number: 5,014,409

[45] Date of Patent: May 14, 1991

[54] FUEL INJECTOR PULLER

[75] Inventor: Charles K. Hippach, Vancouver, Wash.

[73] Assignee: Pro-Tool, Inc., Vancouver, Wash.

[21] Appl. No.: 551,428

[22] Filed: Jul. 10, 1990

[51] Int. Cl.[5] ..... B25B 27/16

[52] U.S. Cl. ..... 29/267

[58] Field of Search ..... 29/267, 270, 278, 282, 29/280, 219; 154/25, 28, 131

[56] References Cited

U.S. PATENT DOCUMENTS

| | | | |
|---|---|---|---|
| 3,110,959 | 11/1963 | Blackstone . | |
| 3,134,574 | 5/1964 | Reuterfors . | |
| 3,670,389 | 6/1972 | Shepanski . | |
| 4,110,886 | 9/1978 | Wendler et al. . | |
| 4,202,088 | 5/1980 | Hansen . | |
| 4,240,192 | 12/1980 | Davis | 29/278 |
| 4,293,992 | 10/1981 | Webb . | |
| 4,346,518 | 8/1982 | Wood | 29/267 |
| 4,780,942 | 11/1988 | Bernat . | |

*Primary Examiner*—Robert C. Watson

*Attorney, Agent, or Firm*—Klarquist, Sparkman, Campbell, Leigh & Whinston

[57] ABSTRACT

The tool of the present invention is especially well adapted for removing fuel injectors from the heads of diesel engines. A handle is attached to flat bar stock which is bent in the approximate shape of the letter J. Specific radii are used for the specific bends in order to provide clearance for the fuel injector and for clearing obstructions within the engine head area. A lower tool engagement portion as a semi-circular cut out for slipping about the body of the fuel injector. A pair of fingers extend about this semi-circular cut out for engaging a flange on the fuel injector body. Rocking the tool forces these extended fingers to lift the fuel injector out of its bore in the engine. The specific radii used in an intermediate portion between the tool engagement area and the handle are specifically adapted to provide clearance and sufficient leverage in order to remove the fuel injector from its bore.

3 Claims, 1 Drawing Sheet

10
20
30
40

10
12
20
50
32
34
30
52
56
54
14
4
40
36

10
10
92
84
82
72
82
80
90

10
70
74
72
84
82
72
70
58
80
74

FUEL INJECTOR PULLER

TECHNICAL FIELD

This invention relates to a hand tool for pulling a part outwardly from a seated location. More particularly, the hand tool of the invention is adapted for pulling a fuel injector outwardly from a seated location in an engine.

BACKGROUND ART

Periodically, fuel injectors must be removed from an engine for cleaning, repair, or replacement. This often times is very difficult because of the crowded nature of the cylinder head or the intake manifold in which the injectors are located. This is especially true of diesel engines wherein the injectors feed fuel directly into the combustion chamber. A particular example is the Cummins "855" series diesel engines where the fuel injectors are located in the cylinder head between the intake and exhaust valves. Very little space exists for positioning a tool in these close quarters.

One particular tool is disclosed in Webb, U.S. Pat. 4,293,992. Webb has a threaded bolt which fits into a matching threaded hole already located in the cylinder head. An arm fits under a flange in the fuel injector and as the bolt is turned, the flange is pulled upward, thus, removing the injector from its bore. Not all engines are equipped with this auxiliary threaded hole.

Another fuel injector puller was proposed by Bernat, U.S. Pat. 4,780,942, which used an intermediate member between the grasping portion and the handle portion to provide a fulcrum to provide the necessary force to remove the injector from its bore. This tool is designed to remove fuel injectors from the intake manifold of engines and although adequate for its intended purpose, this particular design does not adapt itself well to removing injectors from diesel engines where the injectors are nested between the valves of the engine.

A need, therefore, exists for a simple, small tool which can be inserted down between the valves of an engine to gently remove a fuel injection unit from its bore without damaging the fuel injector.

SUMMARY OF INVENTION

It is a primary object of the invention to provide a simple, easy-to-use tool for removing fuel injectors seated in a cylinder head without damaging any adjacent parts of the engine or the fuel injector.

It is another object of the invention to provide a tool for removing fuel injectors from a cylinder head without the need of using auxiliary tools or adjustments within the tool.

It is still another object of the invention to provide a tool for removing fuel injectors from a cylinder head wherein the tool which can operate in very close, tight spaces.

The present invention has a handle portion attached to a flat metal portion. The flat metal portion has a plurality of arcuate bends therein terminating in a straight, upstanding, flat fuel injector gripping portion. The fuel injector gripping portion has a semi-circular recess having a diameter approximately equal to the diameter of the fuel injector body. Two extending fingers having a width approximately equal to the width of the flange of the fuel injector extend on either side of the central recess. The tool, in use, has its flat gripping member placed parallel to the head and inserted about the body of the injector with the extending fingers engaging the flange of the injector. The handle is rotated causing the first arcuate section to act as a fulcrum to gently lift the injector from its bore.

Other objects and advantages of the present invention will be apparent from the following description of a preferred embodiment thereof and from the attached drawings.

DETAILED DESCRIPTION OF THE INVENTION

Figures 1, 2, 3, 4, 5:
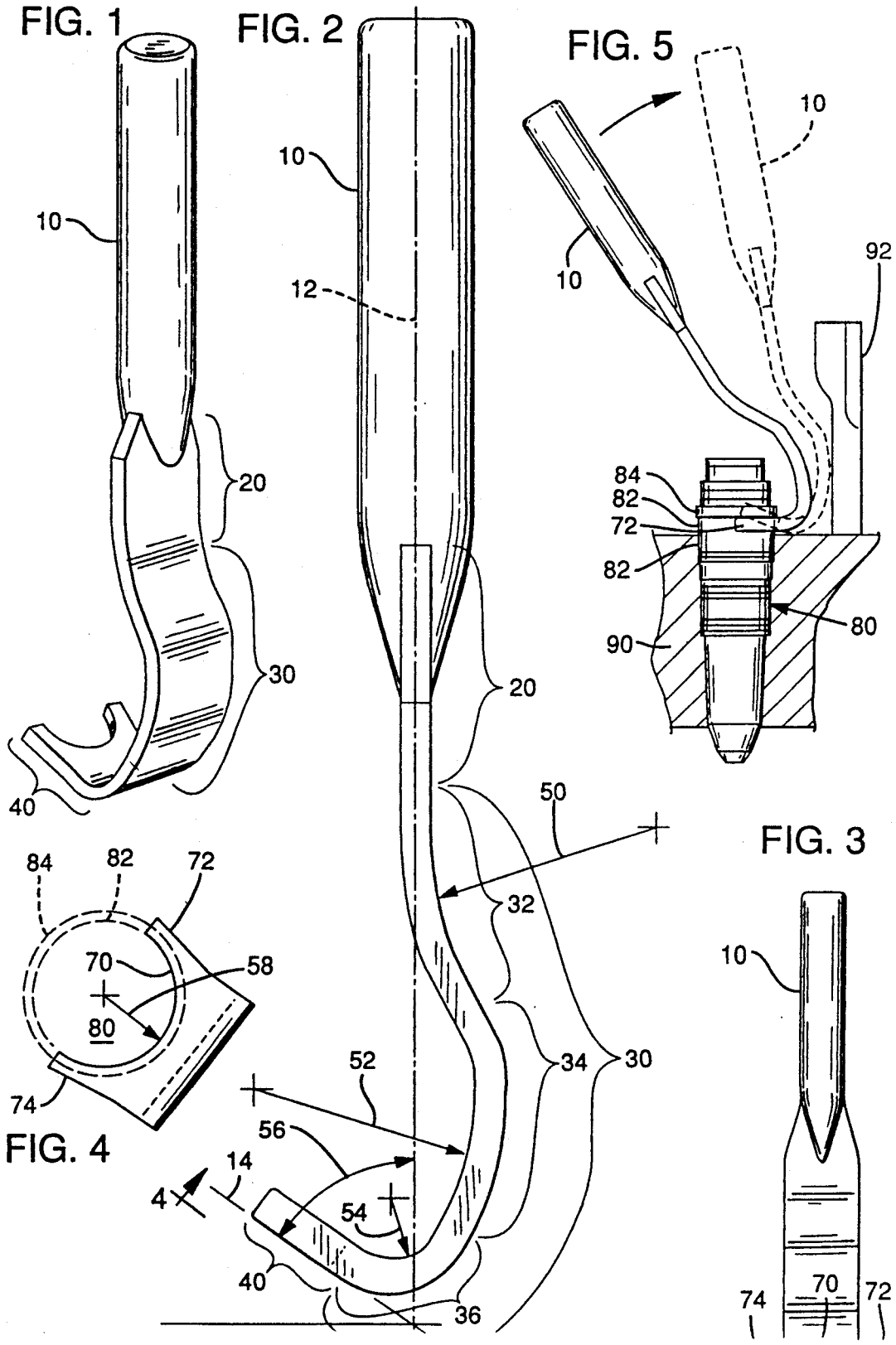
FIG. 1 is a perspective view of the fuel injector puller of the present invention.
FIG. 2 is a side view of the fuel injector puller of the present invention.
FIG. 3 is a reduced front view of the fuel injector puller of the present invention.
FIG. 4 is a bottom view taken along lines 4—4 of FIG. 2 of the puller of the present invention engaging a fuel injector
FIG. 5 shows the fuel injection puller of the present invention engaging a fuel injector mounted in the head of an engine and showing the puller rotated to remove the injector from its bore in the engine head.

Referring now to FIG. 1 and FIG. 2, the puller can be seen to be comprised of a handle 10, a relatively flat upper portion 20 attached to the handle 10, an intermediate portion 30 having arcuate bends along its length and a lower, flat portion 40 for engaging the fuel injector body.

A center line 12, centrally located in the handle, defines generally the center line of the tool in a side view such as FIG. 2. Center line 12 defines a plane in the front view, such as FIG. 3, of the tool. The handle 10 typically is approximately ¾" in diameter and 5" long. The handle 10 was attached in one embodiment to flat bar stock approximately ¼" thick and 1⅜" wide. The bar stock has an upper portion 20 which is generally flat and attaches to the handle 10. The intermediate portion 30 is bent in a series of arcuate bends. A first bend over a portion 32 has a radius 50 of approximately 2". This bend forces the flat bar stock away from the center line 12 of the tool out of the plane defined by center line 12. A second radius 52 over a portion 34 of the bar stock reverses the first bend and brings the bar stock back toward the center line 12 of the tool. A third radius 54 of approximately ½" over the portion 36 forms a fulcrum for the tool as will be explained below. The arcuate bends in the intermediate portion 31 cause the flat bar stock to approximate the shape of the letter "J" in side view. The last or lower portion 40 is a flat portion for engagement of the fuel injector. The bottom of the last portion 40 lies in a plane 14 which subtends an angle 56 upwardly of approximately sixty degrees (60 °) from the plane 12. Angle 56 is chosen to match the particular engine for which the injectors must be removed. The particular angle 56 of sixty degrees (60 °) has been found to work extremely well on Cummins "855" engines. Other engines may require angle 56 to be between forty degrees (40 °) and seventy-five degrees (75 °).

Referring now to FIG. 4, the fuel injector engagement portion can be seen in detail. Section 40 has a semi-circular cut out 70 having a radius 58 of approximately 0.7". Radius 58 is slightly larger than the radius of the body 82 of injector 80. Two extending fingers 72 and 74 lie on each side of this cut out U-shaped area 70. These fingers engage flange 84 extending beyond the body 82 of fuel injector 80.

Referring now to FIG. 5, the use of the tool can be seen. The finger portions 72 and 74 of portion 40 of the tool are placed flat against a cylinder head 90 and moved laterally to position themselves beneath the flange 82 of the fuel injector 80. The tool continues to be moved laterally until the cut out area 70 fully engages the body 82 of the fuel injector 80. At that time, the handle 10 of the tool is rotated in the direction of the arrow shown in FIG. 5 to the position shown by the dashed lines in FIG. 5. Here, as the tool is rotated, the contact points of finger 72 and 74 lift off of head 90, rotating about the third arcuate bend in portion 36, which acts as a fulcrum.

It will be noted by those skilled in the art that the first portion 20 may be extended to act as handle 10. It should also be noted that although the preferred embodiment envisions flat bar stock that round stock or square stock may be used for the upper portion 20 and intermediate portion 30 and only the lower portion 40 needs to be constructed of flat stock.

Obviously, many modifications and variations of the present invention are possible in light of the above teaching. It is, therefore, to be understood that within the scope of the appended claims, the invention may be practiced otherwise than as specifically described lifting the flange 84 and thus the fuel injector 80 out of its bore as the tool rocks upon portion 36. This position is sufficient to lift the injector 80 out of its bore and cylinder head 90. As can be seen in FIG. 5, sufficient clearance exists for placing the tool into position for engaging the injector and for rotating the tool to disengage the injector from its bore.

Although the preferred but not exclusive embodiment of the invention has been heretofore described, however many modifications and variations, both in its structure and operation, equivalent in their characteristics, may be applied for by a person skilled in the art without departing from the spirit of the present invention, it is understood that all the modifications and variations are encompassed in its scope, as defined by the appended claims.

I claim:

1. A fuel injector puller comprising:

an upper handle portion, said upper handle portion lying substantially in a straight line;

a lower portion for engaging a fuel injector seated in a head of an internal combustion engine, the engine having raised portions of the head proximate to the injector, said lower portion formed of substantially flat metal bar stock having a front side and a back side and the lower portion having a semicircular cut-out therein flanked on each side by generally parallel fingers, said semi-circular cut-out for partially surrounding a body of said fuel injector and said fingers for engaging a flange of said fuel injector, wherein said flange extends beyond said body of said fuel injector, an intermediate portion also formed of substantially flat metal bar stock and having a front side and back side, the intermediate portion having a plurality of arcuate bends, said intermediate portion connecting said upper handle portion and said lower portion and the first arcuate bend being concave on the front side of the intermediate portion, located adjacent to the semi-circular cut-out, and the backside of the intermediate portion at the first bend forming a fulcrum to engage said head and provide a pivot point about which to rotate said puller to lift said fingers from said head to lift said fuel injector from said head, the intermediate portion having a second arcuate bend concave on the front side and connected to the first bend, whereby the front side at the second bend does not engage the top of the fuel injector when the lower portion engages the injector flange, and the back side at the second bend does not contact the raised portion of the engine head before the injector has been sufficiently pulled from the engine; and the intermediate portion having a third arcuate bend concave on the back side, connecting the second bend to the handle portion.

2. The fuel injector puller of claim 1 wherein the parallel fingers do not extend beyond the body of the fuel injector when the injector is fully engaged by the puller.

3. The fuel injector puller of claim 1 wherein the parallel fingers terminate at end points on a diameter line including the center of the semi-circular arc, whereby upward pressure applied by the end points creates a net centric force on the injector.

* * * * *